US012313082B2

(12) United States Patent
Ruzicka

(10) Patent No.: US 12,313,082 B2
(45) Date of Patent: May 27, 2025

(54) VOLUTE DESIGN FOR LOWER MANUFACTURING COST AND RADIAL LOAD REDUCTION

(71) Applicant: Fluid Handling LLC, Morton Grove, IL (US)

(72) Inventor: Paul J. Ruzicka, Auburn, NY (US)

(73) Assignee: FLUID HANDLING LLC, Morton Grove (IL)

( * ) Notice: Subject to any disclaimer, the term of this patent is extended or adjusted under 35 U.S.C. 154(b) by 20 days.

(21) Appl. No.: 18/097,645

(22) Filed: Jan. 17, 2023

(65) Prior Publication Data

US 2023/0235751 A1 Jul. 27, 2023

Related U.S. Application Data

(63) Continuation of application No. 15/257,646, filed on Sep. 6, 2016, now abandoned.

(Continued)

(51) Int. Cl.
*F04D 29/44* (2006.01)
*F04D 29/42* (2006.01)

(52) U.S. Cl.
CPC ..... *F04D 29/445* (2013.01); *F04D 29/428* (2013.01)

(58) Field of Classification Search
CPC .. F04D 29/445; F04D 29/428; F04D 29/2216; F04D 29/2255; F04D 29/4233; F04D 1/04; F04D 1/006

(Continued)

(56) References Cited

U.S. PATENT DOCUMENTS 2,134,254 A 10/1938 La Bour
2,627,812 A 2/1953 Mann (Continued)

FOREIGN PATENT DOCUMENTS

CH 219 739 A 2/1942
CN 101718281 A 6/2010

(Continued)

OTHER PUBLICATIONS

CN204200683, English language patent translation with abstract by EPO and Google (Nov. 14, 2016).

(Continued)

*Primary Examiner* — Woody A Lee, Jr.
*Assistant Examiner* — Justin A Pruitt
(74) *Attorney, Agent, or Firm* — William J. Barber; WARE FRESSOLA MAGUIRE & BARBER LLP

(57) ABSTRACT

A volute for a pump featuring a volute or casing having a pump inlet for receiving a fluid being pumped, a pump discharge for providing the fluid, and a volute or casing vane forming double volutes therein. The volute has an upper cutwater farthest from the pump discharge defining an upper cutwater throat area and an end of passage for the upper cutwater, and also has a lower cutwater closest to the pump discharge defining a lower cutwater throat and a corresponding end of passage for the lower cutwater. The upper cutwater throat area is dimensioned to be greater than and not equal to the lower cutwater throat area so the upper cutwater throat area and the lower cutwater throat area provide substantially equal flow velocity at both the upper cutwater and the lower cutwater in response to an angular sweep of the fluid being pumped. The end of passage for the upper cutwater is dimensioned with an upper cutwater passage area that is greater than and not equal to a corresponding lower cutwater passage area of the corresponding (Continued)

Dual Volute According to the Present Invention end of passage for the lower cutwater so that upper and lower cutwater passage areas at the pump discharge are balanced as a function of differing rates of flow of the fluid being pumped therein and so that the fluid being pumped from associated ends of the upper and lower cutwater passage areas meets at the pump discharge with a substantially equal velocity.

5 Claims, 1 Drawing Sheet

Related U.S. Application Data

(60) Provisional application No. 62/213,739, filed on Sep. 3, 2015.

(58) Field of Classification Search
USPC ..... 415/206
See application file for complete search history.

(56) References Cited

U.S. PATENT DOCUMENTS

| | | | |
|---|---|---|---|
| 2,955,540 | A | 5/1957 | Pawlicki |
| 3,289,598 | A | 12/1966 | Buse et al. |
| 3,930,747 | A | 1/1976 | Woollenweber, Jr. |
| 4,008,572 | A | 2/1977 | Woollenweber, Jr. |
| 4,076,450 | A | 2/1978 | Ross |
| 4,202,654 | A | 5/1980 | Marlow |
| 4,383,800 | A | 5/1983 | Becker et al. |
| 4,406,583 | A | 9/1983 | Becker et al. |
| 4,533,294 | A | 8/1985 | Onal |
| 5,673,559 | A | 10/1997 | Benson |
| 5,772,394 | A | 6/1998 | Yokota et al. |
| 6,146,095 | A | 11/2000 | Bross et al. |
| 6,324,847 | B1 | 12/2001 | Pierpont |
| 6,709,235 | B2 | 3/2004 | Hosny |
| 6,779,974 | B2 | 8/2004 | Chien |
| 7,476,077 | B2 | 1/2009 | Woodard et al. |
| 7,517,186 | B2 | 4/2009 | Seitz et al. |
| 7,861,525 | B2 | 1/2011 | Haugen |
| 8,535,212 | B2 | 9/2013 | Jarvik |
| 8,579,603 | B2 | 11/2013 | Oklejas et al. |
| 8,585,355 | B2 | 11/2013 | Henderson et al. |
| 8,939,720 | B2 | 1/2015 | Rodrigues |
| 2011/0255953 | A1 | 10/2011 | Smeulers |
| 2011/0311357 | A1 | 12/2011 | Rodrigues |
| 2013/0058774 | A1 | 3/2013 | Fluckiger et al. |
| 2017/0067481 | A1* | 3/2017 | Ruzica ..... F04D 29/428 |

FOREIGN PATENT DOCUMENTS

| | | | |
|---|---|---|---|
| CN | 202707620 | U | 1/2013 |
| CN | 203939774 | U | 11/2014 |
| CN | 2042000683 | | 3/2015 |
| EP | 2146097 | A1 | 1/2010 |
| GB | 935231 | A | 8/1963 |
| GB | 2412695 | A | 10/2005 |
| JP | 54-175006 | U | 12/1979 |
| JP | 11-166499 | A | 6/1999 |
| JP | 2001-295791 | A | 10/2001 |
| JP | 2006307830 | A | 11/2006 |
| JP | 2008-280939 | A | 11/2008 |

OTHER PUBLICATIONS

Boonyatarokul, Viboon, "Understand Centrifugal Pumps Centrifugal Force." Able Water Pump, ablewaterpump.com, Kasetsart Univ., Thailand, published: Jan. 20, 2012, updated: Oct. 24, 2014. http://www.ablewaterpump.com/web/allcontent/installation/problems1122installa/415-centrifugalpump?showall=1.

English language Abstract and Machine Translation of JP 11-166499A, 1999.

English language Abstract and Machine Translation of JP 54-175006U, 1979.

English language Abstract and Machine Translation of JP 2001-295791A, 2001.

English language Abstract and Machine Translation of JP 2008-280939A, 2008.

English language translation of CH219739A, Feb. 28, 1942.

English language Abstract of CN203939774U, 2014.

English language Abstract of JP2006307830A, 2006.

* cited by examiner

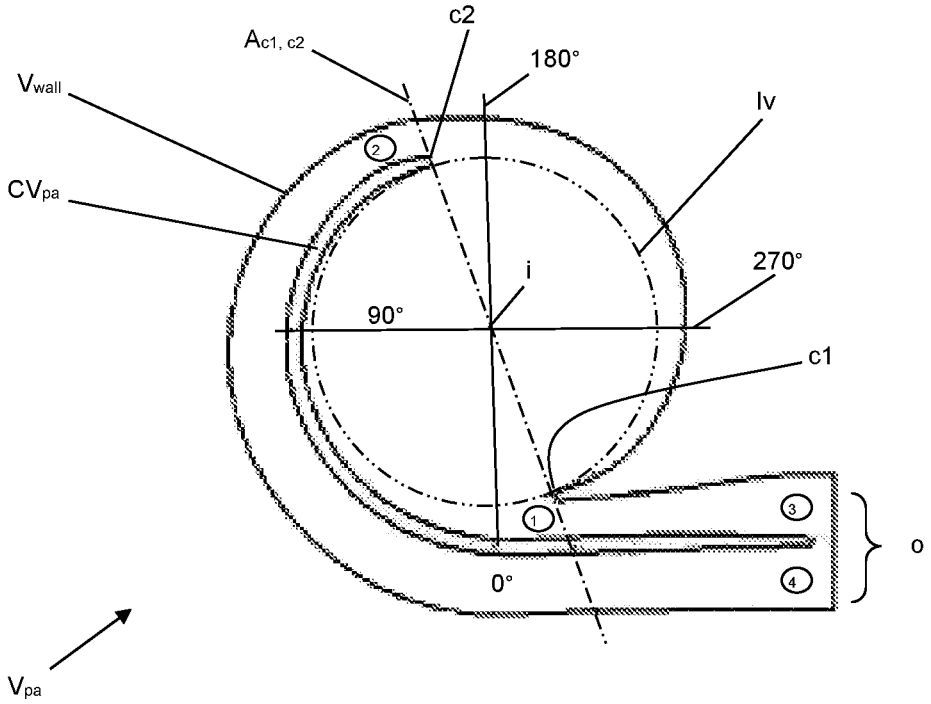
Figure 1 Conventional Dual Volute (Prior Art)
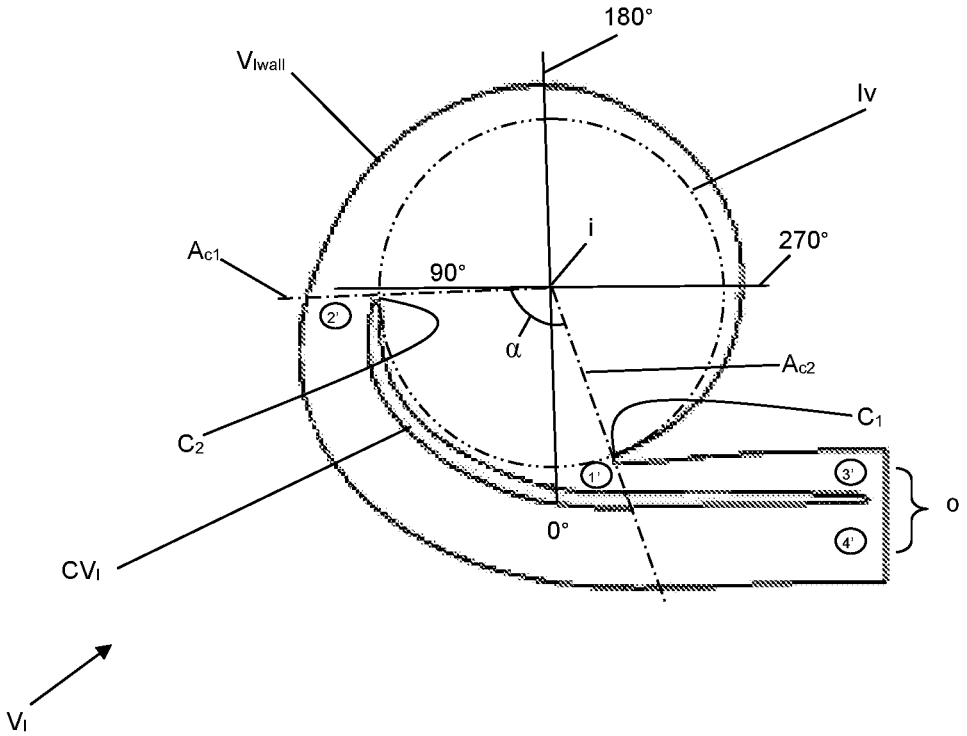
Figure 2: Dual Volute According to the Present Invention

VOLUTE DESIGN FOR LOWER MANUFACTURING COST AND RADIAL LOAD REDUCTION

CROSS-REFERENCE TO RELATED APPLICATION

This application is a continuation of U.S. patent application Ser. No. 15/257,646, filed Sep. 6, 2016, which application claims benefit to provisional patent application Ser. No. 62/213,739, filed 3 Sep. 2015. Both applications are hereby incorporated by reference in their entirety.

BACKGROUND OF THE INVENTION

1. Field of the Invention

The present invention relates to a volute for a pump; and more particularly relates to a pump having an improved volute design.

2. Brief Description of Related Art

FIG. 1 shows a normal or conventional dual volute $V_{pa}$ having a volute wall $V_{wall}$ with a pump inlet represented by the label i and a pump outlet or discharge represented by the label o. The conventional dual volute $V_{pa}$ includes a casing vane $CV_{pa}$ formed therein, which has a lower cutwater c1 and an upper cutwater c2 that are arranged on an axis $A_{c1,\ c2}$ on opposite sides of the volute wall $V_{wall}$ and about 180° apart in a radial separation, e.g., consistent with that shown in FIG. 1. In FIG. 1, the radial degrees of 0°, 90°, 180°, 270° are indicated to provide the reader with an angular radial frame of reference. FIG. 1 also includes a circular dashed line Iv that represents the impeller's outer peripheral vane surface. FIG. 1 also shows the circled reference label 1 as a lower cutwater throat area, the circled reference label 2 as an upper cutwater throat area, the circled reference label 3 as an end of passage for lower cutwater C1, and the circled reference label 4 as an end of passage for upper cutwater c2. In FIG. 1, for the conventional double volute $V_{pa}$ the areas labeled 1 and 2 are equal, and these lower and upper cutwaters c1 and c2 are effectively arranged diametrically opposed.

In the prior art, and consistent with that shown in FIG. 1, the normal double volute $V_{pa}$ utilizes a typical 180 degree opposed casing cutwaters c1 and c2 of equal section area labeled 1 and 2 respectively. In other words, FIG. 1 shows that for the conventional double volute V the sectional areas labeled 1 and 2 formed between the cutwaters c1 and c2 of the casing vane $CV_{pa}$ and the volute wall $V_{wall}$ are substantially equal, and the associated cutwaters c1 and c2 are substantially diametrically opposed. These substantially equal sectional areas labeled 1 and 2 respectively are understood to be the minimum area as measured from the furthest radial edge of the cutwaters C1 and c2 to the next portion of the vertical wall $V_{wall}$ of the volute $V_{pa}$. This sectional area is known as the casing throat area.

One disadvantage of the known volute design $V_{pa}$, e.g., like that shown in FIG. 1, is that the development of the opposed casing tongues results in a long passage length for cutwater farthest away from the pump discharge o, otherwise know as the upper cutwater C2. This long length adds complexity to the casing and increases the difficulty to properly clean the casting. This results in additional costs, and if not properly cast and cleaned will result in loss of pump performance.

In view of this, there is a need for a better double volute design.

SUMMARY OF THE INVENTION

The present invention provides a new volute design that reduces the radial load on the impeller by establishing an improved pressure balance through the operating flow range of a rotodynamic pump.

By way of example, and according to some embodiment, the present invention may be characterized by the total throat section area required by the volute not being distributed equally as in the conventional known double volute (see FIG. 1). The velocities being controlled by these equal sectional areas are also equal as half the pump flow passes through each passage. The area of the throat section of the upper cutwater is increased as a function of the angular sweep as measured along the volute centerline from the cutwater closest to the discharge. As a result of the angular sweep, the rate of flow in this passage is greater than that of a conventional volute (e.g., see FIG. 1). Conversely, the throat area of the cutwater closest to the pump discharge, i.e., the lower cutwater, is reduced as a function of the angular sweep from the upper to the lower cutwater, the rate flow in this passage is reduced. In the present invention, these unequal sectional areas continue to provide roughly equal velocities at both upper and lower cutwaters.

The area of the two passages at the pump discharge is also balanced as a function of the differing rates of flow within these two passages.

It is also established so that the velocity at the end of these two passages, e.g., where they meet in the pump discharge, is substantially equal. In effect, the solution according to the present invention reduces the length of the passage of the upper cutwater furthest away from the pump discharge and increases the size of its associated passage.

Both these features improve the casting quality, reducing the potential of foundry defects while still providing a pressure balance and reducing the resultant radial load over the operating range of the pump.

Additionally, losses through the casing are reduced as a result of the reduction of fluid friction from the shorter passage and the ability to better match velocities of the two passages at the pump discharge. In effect, the present invention reduces the cost and improves the quality of the cast volute.

Moreover, in the case of a split case pump, where the volute is formed in two halves, the upper half is greatly simplified as it has no cutwater and the portion of the passage contained in it, thus reducing the cost of the core, simplifying the cleaning and the tooling required to manufacture the casing half, and reducing the cost to produce the casting.

Specific Embodiments

According to some embodiment of the present invention may include, or take the form of, a volute for a pump, e.g., such as a double volute pump, having the following features:

- a volute wall;
- a pump inlet for receiving a fluid being pumped;
- a pump discharge for providing the fluid being pumped; and
- a casing vane configured on the volute wall.

The casing vane may be configured to form double volutes in the volute, configured with an upper cutwater farthest from the pump discharge defining an upper cutwater throat area and an end of passage for the upper cutwater, and also configured with a lower cutwater closest to the pump discharge defining a lower cutwater throat and a corresponding end of passage for the lower cutwater.

The upper cutwater throat area may be dimensioned to be greater than and not equal to the lower cutwater throat area so that the upper cutwater throat area and the lower cutwater throat area provide substantially equal flow velocity at both the upper cutwater and the lower cutwater in response to an angular sweep of the fluid being pumped.

The end of passage for the upper cutwater may be dimensioned with an upper cutwater passage area that is greater than and not equal to a corresponding lower cutwater passage area of the corresponding end of passage for the lower cutwater so that upper and lower cutwater passage areas at the pump discharge are balanced as a function of differing rates of flow of the fluid being pumped therein and so that the fluid being pumped from associated ends of the upper and lower cutwater passage areas meets at the pump discharge with a substantially equal velocity.

According to some embodiments, the upper cutwater and the lower cutwater may be radially displaced at an angle $\alpha$ that is in a range of between about 108° and about 110°.

Embodiments are also envisioned in which the upper cutwater and the lower cutwater may be radially displaced at an angle $\alpha$ that is substantially less than 180°, e.g., consistent with that set forth herein.

Embodiments are also envisioned in which the upper cutwater and the lower cutwater may be radially displaced at an angle $\alpha$ that is in a range of between 90° and 120°, e.g., also consistent with that set forth herein.

The volute may be configured as part of a double volute pump, e.g., that may include an impeller having impeller vanes and being arranged in one of the double volutes in the casing.

In effect, for the present invention, the total sum of both the upper and lower casing throats are similar to that of the conventional double volute in FIG. 1, but are distributed as the included angle of the radial sweep.

Similar velocities are maintained at the throat section but are not necessarily equal. The net radial loads acting on the impeller are reduced by the maintenance of the velocities and the pressure balance with in the volute. The exit areas are also distributed in the fraction of the flow rate and are controlled to provide an equal velocity at the end of the passages in the pump discharge.

BRIEF DESCRIPTION OF THE DRAWING

The drawing, which is not necessarily drawn to scale, includes the following Figures:

FIG. 1 shows a volute for a pump that is known in the art.

FIG. 2 shows a new and improved volute for a pump, according to some embodiments of the present invention.

DETAILED DESCRIPTION OF THE INVENTION

FIG. 2: The Basic Invention

FIG. 2 shows the present invention, e.g. in the form of a volute $V_I$ for configuring in relation to a pump (not shown), such as a double volute pump. The volute $V_I$ may include one or more of the following features:

a volute wall $V_{wall}$;

a pump inlet i (in) for receiving a fluid being pumped;

a pump discharge o (out) for providing the fluid being pumped; and a casing vane $CV_I$.

The casing vane $CV_I$ may be configured on the volute wall $V_{wall}$ forming double volutes in the volute $V_I$ and being configured with an upper cutwater $C_2$ farthest from the pump discharge o defining an upper cutwater throat area labeled 2' (in a circle) and an end of passage 4' (in a circle) for the upper cutwater $C_2$, and also configured with a lower cutwater $C_1$ closest to the pump discharge o defining a lower cutwater throat labeled 1' (in a circle) and a corresponding end of passage 3' (in a circle) for the lower cutwater $C_1$.

The upper cutwater throat area label 2' (in a circle) may be dimensioned to be greater than and not equal to the lower cutwater throat area labeled 1' (in a circle) so that the upper cutwater throat area labeled 2' (in a circle) and the lower cutwater throat area labeled 1' (in a circle) provide substantially equal flow velocity at both the upper cutwater $C_2$ and the lower cutwater $C_1$ in response to an angular sweep of the fluid being pumped.

The end 4' of passage for the upper cutwater $C_2$ may be dimensioned with an upper cutwater passage area that is greater than and not equal to a corresponding lower cutwater passage area of the corresponding end of passage labeled 3' (in a circle) for the lower cutwater $C_1$ so that upper and lower cutwater passage areas at the pump discharge are balanced as a function of differing rates of flow of the fluid being pumped therein and so that the fluid being pumped from associated ends of the upper and lower cutwater passage areas labeled 3', 4' (in respective circle) meets at the pump discharge o with a substantially equal velocity.

In FIG. 2, the upper cutwater $C_2$ and the lower cutwater $C_1$ are shown to be radially displaced at an angle $\alpha$ that is in a range of between about 108° and about 110°.

The Angle $\alpha$

Moreover, embodiments are envisioned, and the scope of the invention is intended to include, using the upper cutwater $C_2$ and the lower cutwater $C_1$ radially displaced at an angle $\alpha$ that is at least substantially less than 180°, so that the fluid being pumped from associated ends of the upper and lower cutwater passage areas labeled 3', 4' (in respective circle) meets at the pump discharge o with a substantially equal velocity. Moreover, embodiments are envisioned, and the scope of the invention is intended to include, using the upper cutwater $C_2$ and the lower cutwater $C_1$ radially displaced at an angle $\alpha$ that is in a range of between 100° and 120°, so that the fluid being pumped from associated ends of the upper and lower cutwater passage areas labeled 3', 4' (in respective circle) meets at the pump discharge o with a substantially equal velocity. In other words, the scope of the invention is intended to include, embodiments having non-diametrically opposed radially displaced upper cutwater $C_2$ and the lower cutwater $C_1$, for example, that are not radially displaced at any specific angle $\alpha$ that is in the range of between about 108° and about 110°, but where the fluid being pumped from associated ends of the upper and lower cutwater passage areas labeled 3', 4' (in respective circle) meets at the pump discharge o with a substantially equal velocity.

Applications

By way of example, possible applications of the present invention may include the following:

Pumps,
Fans,
Blowers, and
Compressors.

The Scope of the Invention

Further still, the embodiments shown and described in detail herein are provided by way of example only; and the scope of the invention is not intended to be limited to the particular configurations, dimensionalities, and/or design details of these parts or elements included herein. In other words, one skilled in the art would appreciate that design changes to these embodiments may be made and such that the resulting embodiments would be different than the embodiments disclosed herein, but would still be within the overall spirit of the present invention.

It should be understood that, unless stated otherwise herein, any of the features, characteristics, alternatives or modifications described regarding a particular embodiment herein may also be applied, used, or incorporated with any other embodiment described herein. Also, the drawings herein are not drawn to scale.

Although the invention has been described and illustrated with respect to exemplary embodiments thereof, the foregoing and various other additions and omissions may be made therein and thereto without departing from the spirit and scope of the present invention.

What I claim is:

1. A volute ($V_I$) for a pump comprising:

a volute wall ($V_{Wall}$);

a pump inlet (i) for receiving a fluid being pumped;

a pump discharge (o) for providing the fluid being pumped; and a casing vane ($CV_I$) configured on the volute wall ($V_{Wall}$) forming double volutes in the volute ($V_I$) and being configured with an upper cutwater ($C_2$) farthest from the pump discharge (o) defining an upper cutwater throat area (2') and an end of passage (4') for the upper cutwater ($C_2$), and also configured with a lower cutwater ($C_1$) closest to the pump discharge (o) defining a lower cutwater throat area (1') and a corresponding end of passage (3') for the lower cutwater ($C_1$), the fluid flowing in the volute ($V_I$) in a direction from the upper cutwater ($C_2$) to the lower cutwater ($C_1$) and out the pump discharge (o), the upper cutwater ($C_2$) being configured on an upper cutwater axis ($A_{c1}$) with respect to the pump inlet (i), the lower cutwater ($C_1$) being configured on a lower cutwater axis ($A_{c2}$) with respect to the pump inlet (i), the upper cutwater axis ($A_{c1}$) and the lower cutwater axis ($A_{c2}$) being radially displaced at an angle α that is substantially less than 180° in radial separation with respect to the pump inlet (i) and in the direction of the fluid flowing in the volute ($V_I$) from the upper cutwater ($C_2$) to the lower cutwater ($C_1$) and out the pump discharge (o);

the upper cutwater throat area (2') being dimensioned to be greater than and not equal to the lower cutwater throat area (1') so that the upper cutwater throat area (2') and the lower cutwater throat area (1') provide substantially equal flow velocity at both the upper cutwater ($C_2$) and the lower cutwater ($C_1$) in response to an angular sweep of the fluid being pumped; and the end of passage (4') for the upper cutwater ($C_2$) being dimensioned with an upper cutwater passage area that is greater than and not equal to a corresponding lower cutwater passage area of the corresponding end of passage (3') for the lower cutwater ($C_1$) so that upper and lower cutwater passage areas at the pump discharge (o) are balanced as a function of differing rates of flow of the fluid being pumped therein and so that the fluid being pumped from associated ends (3', 4') of the upper and lower cutwater passage areas meets at the pump discharge (o) with a substantially equal velocity.

2. The volute ($V_I$) according to claim 1, wherein the angle α is in a range of between 100° and 120°.

3. A volute ($V_I$) for a pump comprising:

a volute wall ($V_{Wall}$);

a pump inlet (i) for receiving a fluid being pumped;

a pump discharge (o) for providing the fluid being pumped; and a casing vane ($CV_I$) configured on the volute wall ($V_{Wall}$) forming double volutes in the volute ($V_I$) and being configured with an upper cutwater ($C_2$) farthest from the pump discharge (o) defining an upper cutwater throat area (2') and an end of passage (4') for the upper cutwater ($C_2$), and also configured with a lower cutwater ($C_1$) closest to the pump discharge (o) defining a lower cutwater throat area (1') and a corresponding end of passage (3') for the lower cutwater ($C_1$);

the upper cutwater throat area (2') being dimensioned to be greater than and not equal to the lower cutwater throat area (1') so that the upper cutwater throat area (2') and the lower cutwater throat area (1') provide substantially equal flow velocity at both the upper cutwater ($C_2$) and the lower cutwater ($C_1$) in response to an angular sweep of the fluid being pumped; and the end of passage (4') for the upper cutwater ($C_2$) being dimensioned with an upper cutwater passage area that is greater than and not equal to a corresponding lower cutwater passage area of the corresponding end of passage (3') for the lower cutwater ($C_1$) so that upper and lower cutwater passage areas at the pump discharge (o) are balanced as a function of differing rates of flow of the fluid being pumped therein and so that the fluid being pumped from associated ends (3', 4') of the upper and lower cutwater passage areas meets at the pump discharge (o) with a substantially equal velocity, wherein the upper cutwater ($C_2$) and the lower cutwater ($C_1$) are radially displaced at an angle α that is in a range of between about 108° and about 110°.

4. The volute ($V_I$) according to claim 1, wherein the volute forms part of a double volute pump having an impeller with impeller vanes and being arranged in one of the double volutes in the volute ($V_I$) or casing.

5. The volute ($V_I$) according to claim 1, wherein the angle α is in a range of between about 108° and about 110°.

* * * * *